US005951905A

United States Patent [19]

Iwai et al.

[11] Patent Number: 5,951,905

[45] Date of Patent: Sep. 14, 1999

[54] THAWING-HEATING TRAY AND THAWING-HEATING METHOD

[75] Inventors: Shuichi Iwai; Takahiro Nonaka, both of Tokyo, Japan

[73] Assignee: Kiyari Co., Ltd., Tokyo, Japan

[21] Appl. No.: 09/104,381

[22] Filed: Jun. 25, 1998

[30] Foreign Application Priority Data

Feb. 3, 1998 [JP] Japan ..... 10-049329

[51] Int. Cl.[6] ..... H05B 6/80

[52] U.S. Cl. ..... 219/725; 99/DIG. 14

[58] Field of Search ..... 219/725, 730, 219/732, 728; 426/112, 234, 235, 113, 203; 99/DIG. 14

[56] References Cited

U.S. PATENT DOCUMENTS

| | | | |
|---|---|---|---|
| 4,542,271 | 9/1985 | Tanonis et al. | 219/730 |
| 5,097,107 | 3/1992 | Watkins et al. | 219/725 |
| 5,107,087 | 4/1992 | Yamada et al. | 219/728 |
| 5,117,078 | 5/1992 | Beckett | 219/730 |
| 5,391,864 | 2/1995 | Bodor et al. | 219/730 |
| 5,565,228 | 10/1996 | Gics | 426/107 |

FOREIGN PATENT DOCUMENTS

| | | |
|---|---|---|
| 8-180970 | 7/1996 | Japan . |
| 9-98888 | 4/1997 | Japan . |

*Primary Examiner*—Teresa Walberg
*Assistant Examiner*—Jeffrey Pwu
*Attorney, Agent, or Firm*—Kanesaka & Takeuchi

[57] ABSTRACT

In order to sufficiently and properly thaw frozen food such as frozen sushi, a thawing-heating tray made of dielectric material is provided with thick portions disposed in the central region and the peripheral region thereof, respectively. Fixed to this tray is a reflector. The frozen food is placed on the tray and is then thawed by an electronic oven.

8 Claims, 7 Drawing Sheets

TEMPERATURE DATA

| KINDS OF NETA | | | |
|---|---|---|---|
| TEMPERATURE OF NETA | TEMPERATURE OF SHARI | TEMPERATURE OF NETA | TEMPERATURE OF SHARI |
| SQUID | | SCALLOP | |
| 16 | 46 | 13 | 43 |
| RED MEAT OF TUNA | | SALMON | |
| 13 | 41 | 21 | 49 |
| SWEET PRAWN | | BELLY MEAT OF TUNA | |
| 15 | 40 | 9 | 43 |
| CONGER EEL | | OMELET | |
| 28 | 55 | 18 | 32 |

FIG.11

TEMPERATURE DATA

| KINDS OF NETA | | | |
|---|---|---|---|
| TEMPERATURE OF NETA | TEMPERATURE OF SHARI | TEMPERATURE OF NETA | TEMPERATURE OF SHARI |
| SQUID | | SCALLOP | |
| 18 | 55 | 25 | 31 |
| RED MEAT OF TUNA | | SALMON | |
| 10 | 29 | 29 | 45 |
| SWEET PRAWN | | BELLY MEAT OF TUNA | |
| 19 | 33 | 10 | 42 |
| CONGER EEL | | OMELET | |
| 28 | 47 | 20 | 34 |

FIG.12

TEMPERATURE DATA

| KINDS OF NETA | | | |
|---|---|---|---|
| TEMPERATURE OF NETA | TEMPERATURE OF SHARI | TEMPERATURE OF NETA | TEMPERATURE OF SHARI |
| SQUID | | SCALLOP | |
| 8 | 80 | 4 | 59 |
| RED MEAT OF TUNA | | SALMON | |
| 20 | 42 | 7 | 46 |
| SWEET PRAWN | | BELLY MEAT OF TUNA | |
| 9 | 50 | 7 | 46 |
| CONGER EEL | | OMELET | |
| 16 | 70 | 6 | 44 |

FIG.13

THAWING-HEATING TRAY AND THAWING-HEATING METHOD

FIELD OF THE INVENTION

The present invention relates to a thawing-heating tray and a method of thawing-heating frozen food such as frozen sushi using the aforementioned thawing-heating tray. More particularly, the present invention relates to a tray and a method for thawing-heating frozen food such as frozen sushi by placing the food on the thawing-heating tray and irradiating it with microwave.

BACKGROUND OF THE INVENTION

The technology to thaw and heat frozen food such as frozen sushi by placing the food on a thawing-heating tray and irradiating it with microwave has been disclosed in JPA 8-180970 and JPA 9-98888. A tray claimed in claim 6 and disclosed in the second embodiment described in paragraphs 0019 through 0022 of JPA 8-180970 has a thick portion in the center thereof and is therefore most similar with the tray of the present invention. JPA 8-180970 will be hereinafter explained with reference to FIGS. 7 through 10.

FIG. 7 is a sectional view of a microwave thawing-heating apparatus for thawing sushi according to the first embodiment of the aforementioned JPA 8-180970. Microwave is supplied in a thawing-heating chamber 10 from magnetron through a wave guide 11. A rotating table (a disk) 12 made of conductive material such as aluminum is disposed in a lower part of the thawing-heating chamber 10. The rotating table 12 is rotated by driving means. Disposed on the rotating table 12 through a supporting member 13 made of material such as expanded polystyrene is a surface-wave-forming plate (a tray) 14 on which some pieces of sushi 3 are placed. The distance between the ceiling (upper surface) of the thawing-heating chamber 10 in which the wave guide 11 is arranged and rotating table 12 is set approximately $n\lambda/2$ (n is integer) wherein $\lambda$ is wave-length of microwave. In the thawing-heating chamber 10, an electric field of a standing wave F is formed vertically as illustrated. The aforementioned surface-wave-forming plate 14 is located close to a part where the electric field strength of standing wave F is high.

This surface-wave-forming plate 14 is made of dielectric material and functions to form surface wave (plane wave) and is held by the supporting member 13. As for this surface-wave-forming plate 14, among some dielectric materials, the material, the dielectric loss angle is less than 0.01 and the relative permittivity $\epsilon_0$ is more than 40 is preferable, so that, alumina having relative permittivity $\epsilon_0$ approximately 9 is the most suitable.

As shown in FIG. 8, microwave radiated from wreak guide 11 impinges into the surface-wave-forming plate 14 through the upper surface and the sides thereof. Moreover, the permeated microwave reflects by the rotating table 12 made of conductive material and thus impinges into the surface-wave-forming plate 14 through the bottom thereof. In this way, the microwave is transmitted within the surface-wave-forming plate 14 as indicated by arrows 100. At this time, on the surface of surface-wave-forming plate 14, surface wave of microwave is formed. Since the surface-wave-forming plate 14 is located on the part where the electric field strength of the standing wave F formed between the ceiling and the rotating table 12 in the thawing-heating chamber 10 is high, the strength distribution formed finally by this standing wave and the surface wave mentioned above is indicated as the numeral 200 in the drawing.

Accordingly, the longer the distance from the surface-wave-forming plate 14, the smaller the electric field strength formed on the surface-wave-forming plate 14. According to the microwave electric field distribution, warm shari (pre-steamed rice) 1 and a cold neta (raw fish) 2 can be provided.

By the way, the surface-wave-forming plate 24 has the size such that frozen sushi 3 for four meals can be placed on the top. When the size of surface-wave forming plate 24 is larger, the formation of the surface wave in the central region becomes worse and it will be unable to thaw and heat all pieces of the frozen sushi 3 on the surface-wave-forming plate equally, because the strength distribution 401 in the central region becomes smaller than the strength distribution 400 in the peripheral region as shown in FIG. 9.

Therefore, the surface-wave-forming plate 24 which is thicker in a central portion 24C as shown in FIG. 10 is employed. By making the central portion 24C of the surface-wave-forming plate 24 thicker as mentioned, the central portion 24C functions as an adjuster, thereby making microwave propagation efficiently and also ensuring uniform electric field strength all over the surface-wave-forming plate 24, consequently.

In addition, according to JPA 8-180970, the surface-wave-forming plate 24 is made of alumina, relative permittivity of which is approximately 9, and is set to have a diameter of 500 mm so as to enable processing of, for example, 32 pieces of sushi for four meals at a time, and is set to have a thickness of 5 mm in the peripheral region thereof. The distance (the stratum of air) between the rim portion and the rotating table 22 is set to 17.5 mm by a support 23 made of synthetic resin or alumina. And also, the area within the diameter of 200 mm in the central portion 24C of the surface-wave-forming plate 24 has a thickness of 12.5 mm and the distance between the central portion 24C and the rotating table 22 is set to 10 mm.

Inventors of the present invention repeated experiments of the surface-wave-forming plate, the central portion 24C of which is thick as shown in FIG. 10, and found that, in case of the surface-wave-forming plate (hereinafter, sometimes called as "tray") made of alumina, dielectrics of which is large as mentioned above, the electric field strength gets "unevenness" or "irregularity" and it was therefore unable to thaw and heat the frozen sushi 3 every time in the same way.

OBJECT AND SUMMARY OF THE INVENTION

It is an object of the present invention to solve the above conventional problems and to provide a thawing-heating tray which can thaw and heat frozen food (preferably, frozen sushi) every time in the same way and a method of thawing-heating frozen food by using it.

A thawing-heating tray of the present invention is made of dielectric material and is formed of thick portions, disposed in the central region and the peripheral region of the tray, respectively.

Disposing the thick portion in the peripheral region as mentioned above reduces unevenness or "irregularity" in the electric field strength and enables frozen food placed on the top of the tray to be thawed and heated always in the same way.

BRIEF DESCRIPTION OF DRAWINGS

FIG. 11 is a diagram showing temperature data of results of thawing;

FIG. 12 is a diagram showing temperature data of results of thawing; and

FIG. 13 is a diagram showing temperature data of results of thawing.

DESCRIPTION OF THE PREFERRED EMBODIMENT

Figure 1:
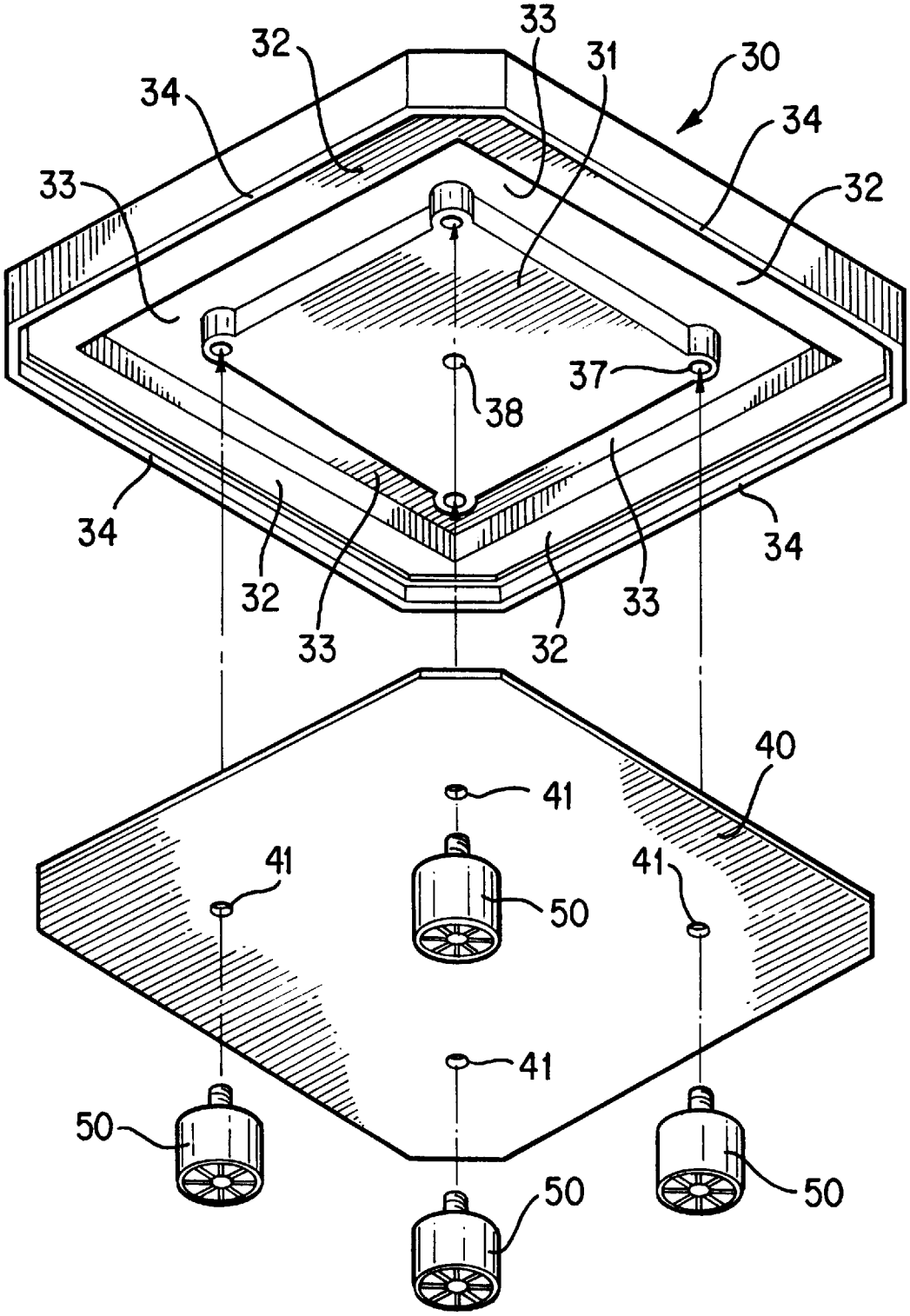
FIG. 1 is a perspective view showing a connection between a tray according to an embodiment and a reflector.
Figure 2:
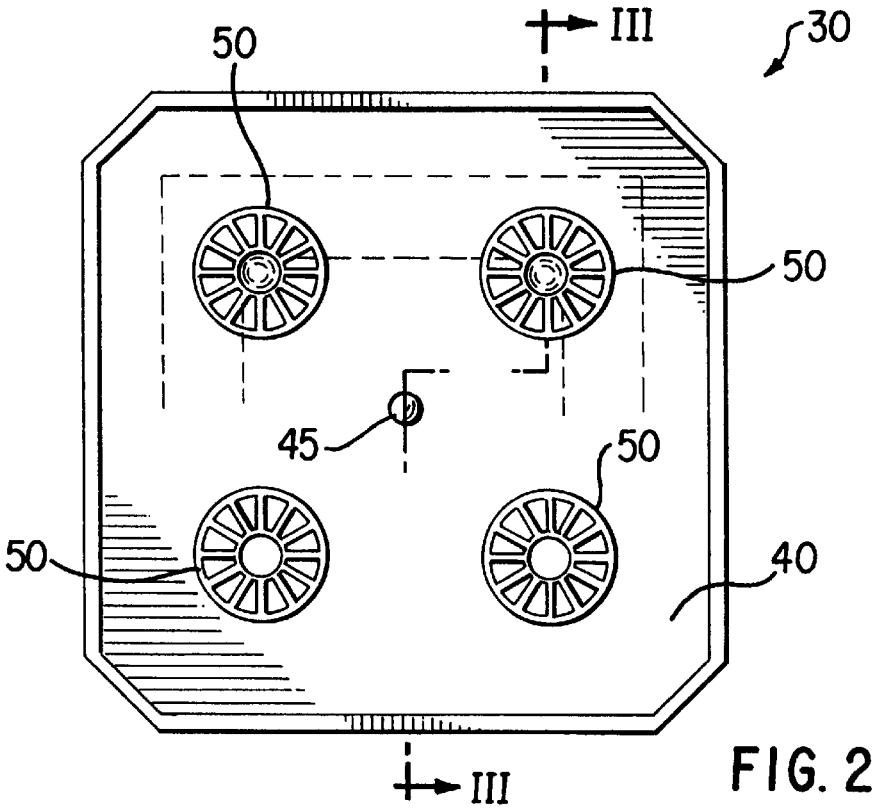
FIG. 2 is a bottom view showing the tray with the reflector.
Figure 3A:
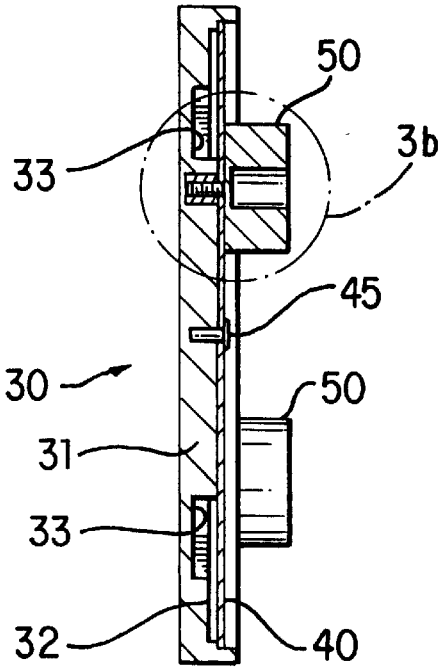
FIG. 3*a* is a sectional view taken along the line III—III of FIG. 2.
Figure 3B:
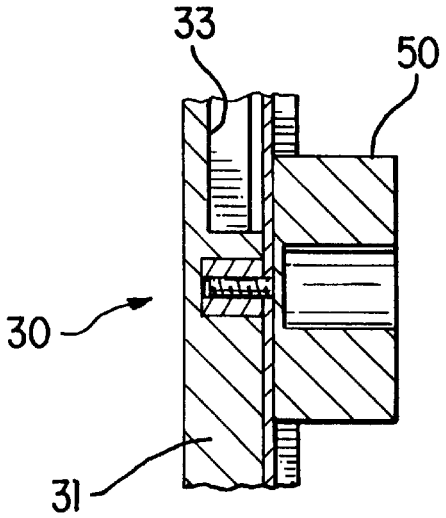
FIG. 3*b* is an enlarged view of a portion 3B of FIG. 3*a;*
Figure 4A:
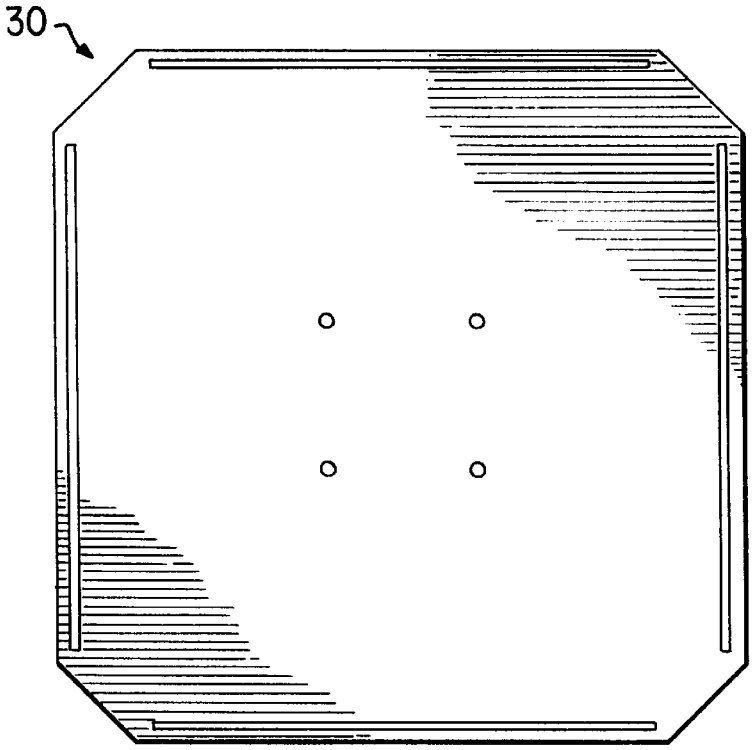
FIG. 4*a* is a plan view of the tray with the reflector.
Figure 4B:
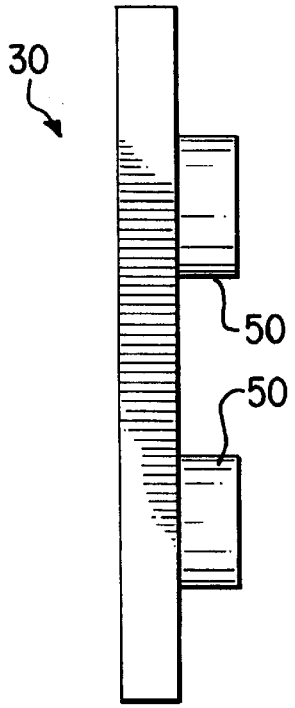
FIG. 4*b* is a side view of the tray shown in FIG. 4*a;*
Figure 6A:
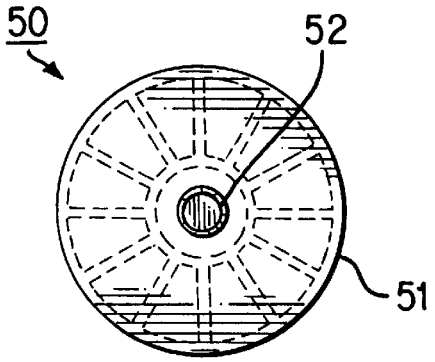
FIG. 6*a* is a plan view of a support.
Figure 6B:
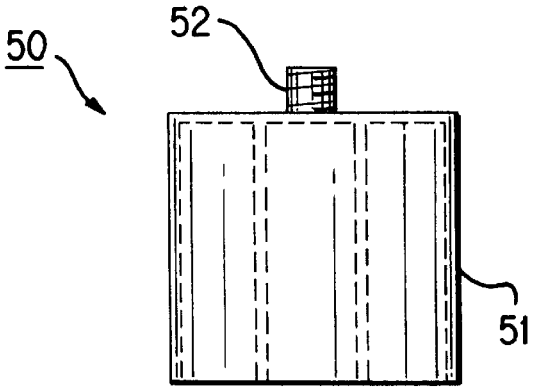
FIG. 6*b* is a side view of the support shown in FIG. 6*a;*
Figure 5A:
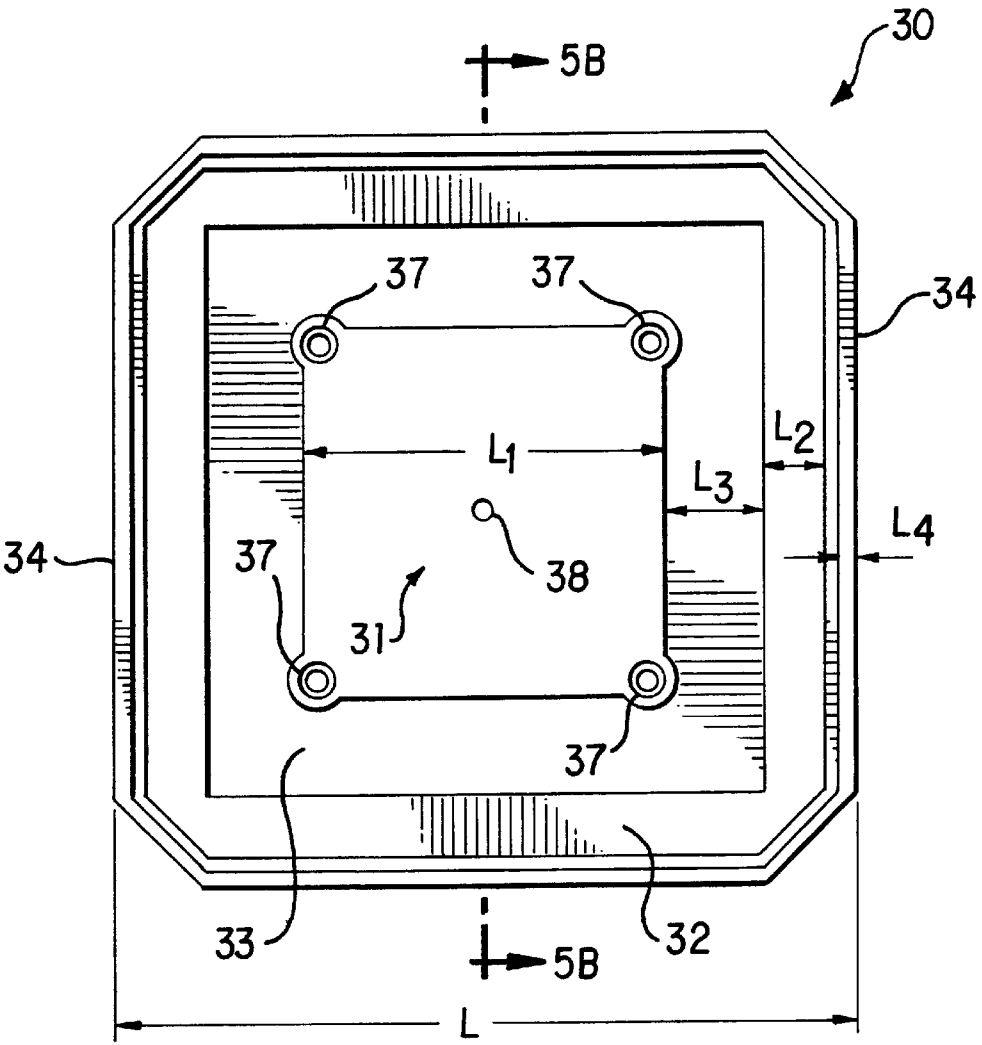
FIG. 5*a is a bottom view of the tray;*
Figure 5B:
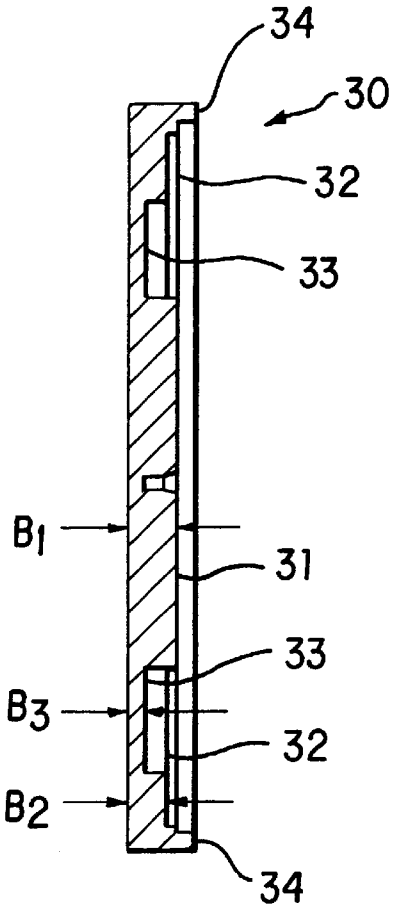
FIG. 5*b* is a sectional view taken along the line 5B—5B of FIG. 5*a;*
Figure 7:
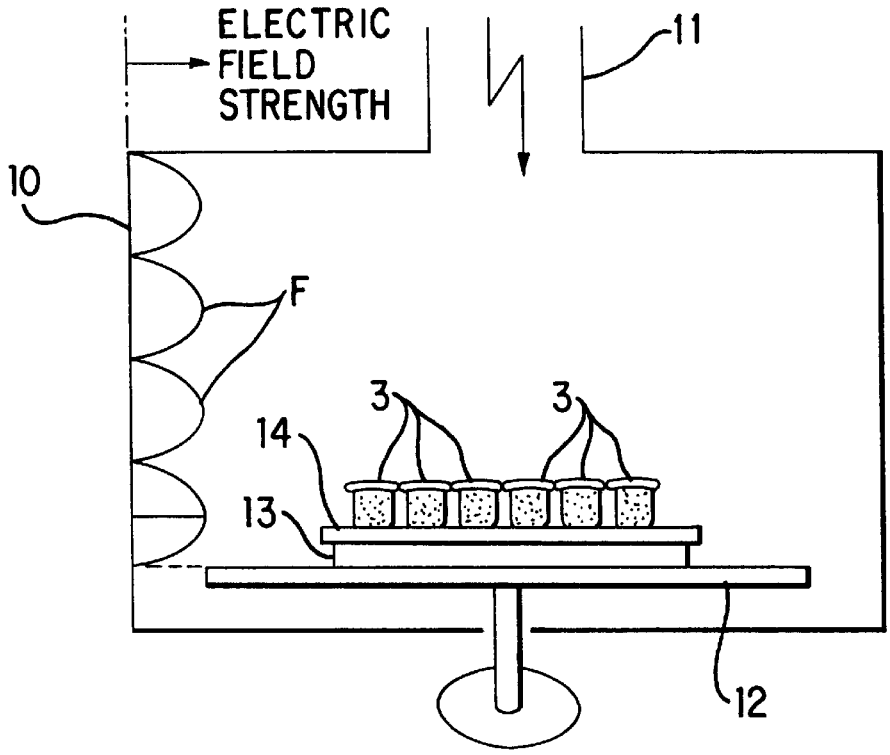
FIG. 7 PRIOR ART
FIG. 7 is a sectional view showing a conventional example.
Figure 8:
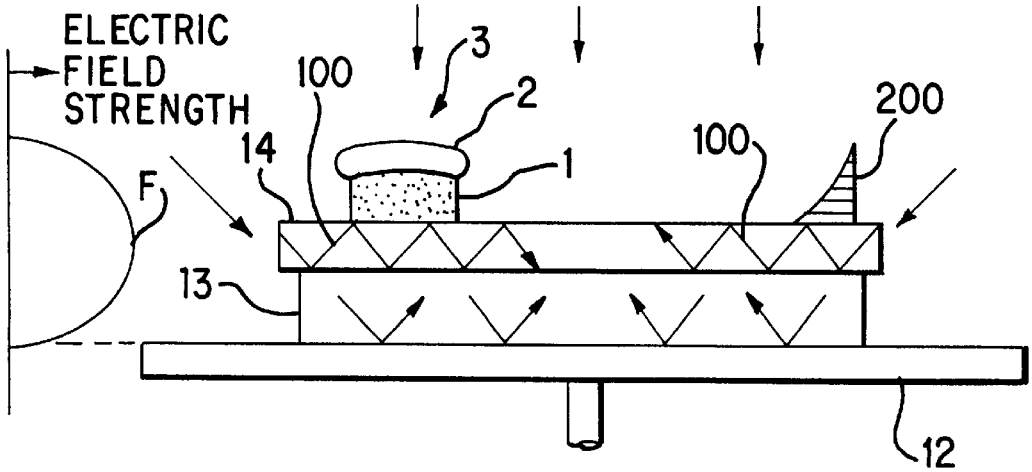
FIG. 8 PRIOR ART
FIG. 8 is a sectional view showing the conventional example.
Figure 9:
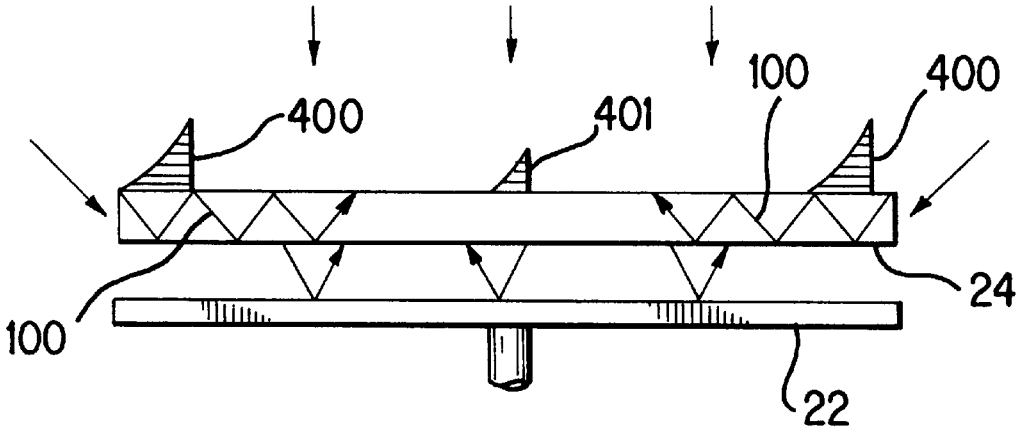
FIG. 9 PRIOR ART
FIG. 9 is a sectional view showing the conventional example.
Figure 10:
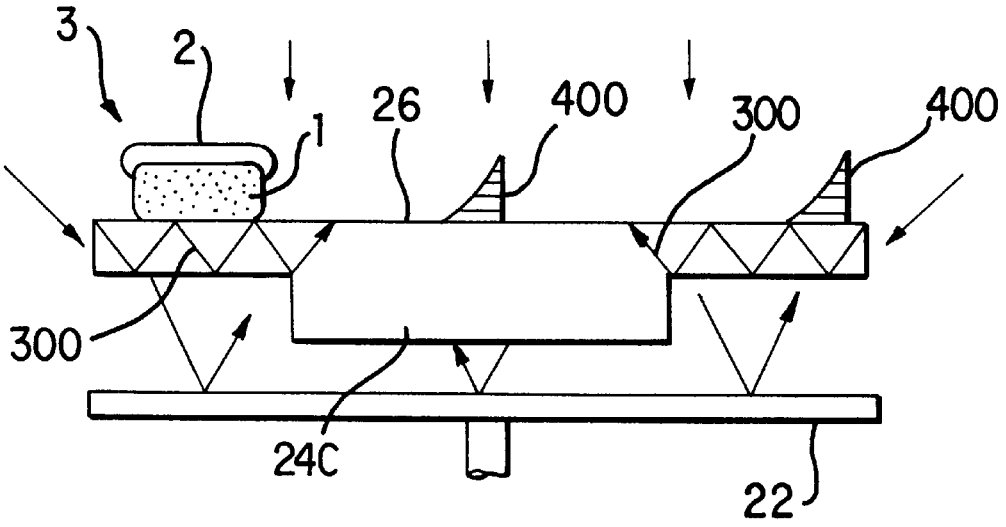
FIG. 10 PRIOR ART
FIG. 10 is a sectional view showing the conventional example.

FIG. 1 is a perspective view seen from downward of a thawing-heating tray according to a preferable embodiment and a reflector attached to the tray, FIG. 2 is a bottom view showing the tray with the reflector, FIG. 3*a* is a sectional view taken along line III—III of FIG. 2, FIG. 3*b* is an enlarged view of a portion 3B in FIG. 3*a*, FIGS. 4*a* and 4*b* are a plan view and a side view of the tray with the reflector, respectively, FIG. 5*a* is a bottom view of the tray, FIG. 5*b* is a sectional view taken along line 5B—5B of FIG. 5*a*, and FIGS. 6*a* and 6*b* are a plan view (top view) and a side view of a support, respectively.

The tray 30 is formed in a substantial regular square in plan with the four corners thereof being cut off and has a flat top surface and a bottom surface which is shaped concave and convex in such a manner as to have a thick portion 31 in the central region thereof and a thick portion 32 around the periphery thereof and to provide a thin portion 33 between the thick portions 31 and 32. The tray 30 is formed with a convexity 34 projecting from the rim portion all around the tray.

The thick portion 31 in the central region is formed in a regular square. The thick portion 32 in the peripheral region extends along all the rim of the tray 30.

As shown in FIG. 5*a*, when the width of a side of the regular square of the tray 30 is L, the width of the thick portion 31 is $L_1$, the width of the thick portion 32 is $L_2$, and the width of the thin portion 33 is $L_3$, L is preferably 190–230 mm, more preferably 200–210 mm. It is preferable that $L_1$ is 40–60%, more preferably 45–55%, of L, $L_2$ is 15–23%, more preferably 17–20%, of L, and $L_3$ is 21–31%, more preferably 25–29%, of L. The width $L_4$ of the convexity 34 is preferably in a range of 0.5–5 mm.

As shown in FIG. 5*b*, when the thickness of the thick portion 31 in the central region is $B_1$, the thickness of the thick portion 32 around the periphery is $B_2$, and the thickness of the thin portion 33 is $B_3$, it is preferable that $B_1$ is 10–15 mm, more preferably 12–13 mm, B2 is 67–100%, more preferably, 80–85%, of $B_1$, and $B_3$ is 27–40%, more preferably 30–35%, of $B_1$.

When the wavelength of microwave is in a range of 2–3 MHz, the relative permittivity of the tray 30 is preferable equal or more than 2.4 and less than 4, more preferably in a range between 3 and 4. For this kind of material, modified polyphenylene ether resin is preferable. Also preferable is a composite of 10–50 parts by weight of titanium oxide, 10–50 parts by weight of glass fiber, and 100 parts by weight of thermoplastic resin, which has heat-deformation temperature of 80° C. or more (for example, polyphenylene ether, or a composite of polyphenylene ether and vinyl aroma).

The thick portion 31 in the central region is provided with bits 37 disposed at four corners thereof, respectively. Screwed into each bit 37 is a support 50 as described later. The thick portion 31 is formed with a hole 38 at the center thereof.

The convexity 34 is formed with a stepped portion extending along the inner surface thereof, into which the rim of the reflector 40 engages.

The reflector 40 is formed in a substantial regular square with four corners being cut off in such a manner as to fit the rear surface of the tray 30 and is formed with small holes 41 located corresponding to the four bits 37 and the hole 38 of the thick portion 31, respectively.

The reflector 40 is fixed to the tray 30 by fastening a screw 45 into the hole 38 and by fastening the supports 50 made of synthetic resin into the bits 37. Each support 50 comprises a substantial cylindrical main body 51 and a threaded portion 52 projecting from the center of an upper surface of the main body 51 as shown in FIG. 6*b*. The threaded portion 52 is screwed into each bit 37.

As shown in FIG. 3*b* and FIG. 4*b*, when the reflector 40 and the supports 50 are fixed to the tray 30, the lower ends of the supports 50 project downward.

EXAMPLES

Hereinafter, the description will now be made as regard to examples and comparative examples.

Example 1

Example 1 was made in such a manner that the sizes L, $L_1$, $L_2$, $L_3$, $L_4$, $B_1$, $B_2$, and $B_3$ as shown in FIGS. 5*a* and 5*b* were set as follows and a reflector 40 made of aluminum and having a thickness of 1 mm was fixed to a tray 30 made of modified polyphenylene ether resin and having relative permittivity of 3.68 (1 MHz), by a screw 45 and supports 50.

L=200 mm $L_1$=99 mm $L_2$=19 mm $L_3$=25.5 mm $L_4$=4 mm $B_1$=12.6 mm $B_2$=10.5 mm $B_3$=4.2 mm

As shown in FIG. 11, 8 pieces of frozen sushi (temperature −20° C.) were placed on the tray 30 and thawed and heated for 60 seconds by an electronic oven of 2650 W. Each piece of frozen sushi consists of 22 g of shari and various kinds and sizes of neta as follows. Squid: 10 g, Red meat of tuna: 10 g, Sweet prawn (shrimp): 2 pieces (7 g×2), Conger eel: 8 g, Scallop: 6S-standard, Salmon: 8 g, Belly meat of tuna: 10 g, and Omelet: 15 g.

Temperatures of the shari and neta right after the thawing-heating were measured by a thermocouple and the results were tabulated in FIG. 11. The temperatures are averages of 10 times of the same tests. The same is true for the following comparative examples.

Comparative Example 1

The process of thawing-heating frozen sushi was the same as that of Example 1 except using a tray 30 having no thick portion 32 in the peripheral region instead of the tray 30 of Example 1. Temperatures of the shari and neta right after the thawing-heating were tabulated in FIG. 12.

Comparative Example 2

The process of thawing-heating frozen sushi was the same as that of Comparative Example 1 except using a tray made of alumina and having relative permittivity of 9. Temperatures of the shari and neta right after thawing-heating were tabulated in FIG. 13.

These temperature data of Example 1 and Comparative Examples 1 and 2 are the results of 10 times of tests. In addition, after each test, tasting was conducted for each piece of thawed sushi on the tray in order to check if the shari is moderately warn and the neta on the top is cold. The thawing was judged as acceptable only in case where all 8 pieces of sushi on the tray were acceptable and judged as unacceptable in case where there was even only one piece in wrong condition (for example, the shari was too warm, the neta got warmed, or the neta was not thawed enough).

The results of the judgement are as follows.

Example 1: All 10 times are acceptable.

Comparative Example 1: Only 7 times out of 10 are acceptable.

Comparative Example 2: Only 6 times out of 10 are acceptable.

As apparent from the above results, frozen sushi can be thawed properly by the example of the present invention.

As apparent from the example and comparative examples mentioned above, frozen food, particularly frozen sushi, can be thawed properly and delicious food can be provided quickly by the present invention. According to the present invention, uneven thawing can be securely prevented, thereby providing thawed food which consumers are always satisfied.

What is claimed is:

1. A thawing-heating tray made of a dielectric material comprising, a central region and a peripheral region surrounding the central region, a flat upper surface extending throughout the central region and the peripheral region for disposing a material to be heated, a first thick portion disposed in the central region to extend downwardly from the flat upper surface, a second thick portion disposed in the peripheral region of said tray to extend downwardly from the flat upper surface, and a thin portion disposed between the first and second thick portions to form a concavity at a rear side opposite to the flat upper surface, said thick portions having thicknesses greater than the thickness of the thin portion to thereby provide even electric field strength on the flat upper surface.

2. A thawing-heating tray as claimed in claim 1, wherein relative permittivity of said dielectric material is equal to or more than 2.4 and less than 4.

3. A thawing-heating tray as claimed in claim 1, wherein $B_3$ is 27–40% of $B_1$ and $B_2$ is 67–100% of $B_1$, wherein $B_1$ is the thickness of the thick portion in the central region, $B_2$ is the thickness of the thick portion in the peripheral region, and $B_3$ is the thickness of said thin portion.

4. A thawing-heating tray as claimed in claim 1, wherein said tray is formed in a substantial square, and $L_1$ is 40–60% of L, $L_2$ is 15–23% of L, and $L_3$ is 21–31% of L wherein L is the width of the tray in a side direction of said square, $L_1$ is the width of the thick portion in the central region, $L_2$ is the width of the thick portion in the peripheral region, and $L_3$ is the width of the thin portion between the thick portions.

5. A thawing-heating tray as claimed in claim 4, wherein said tray is formed in a substantial square with four corners being cut off.

6. A thawing-heating method, comprising a step of placing frozen food on the thawing-heating tray as claimed in claim 1 and then thawing and heating the frozen food with microwave.

7. A thawing-heating method as claimed in claim 6, wherein said frozen food is frozen sushi.

8. A thawing-heating tray as claimed in claim 1, further comprising a convexity formed at a rim portion of the periphery region and extending downwardly from the flat surface, and a reflector connected to the rear side to be surrounded by the convexity.

* * * * *